US006253052B1

(12) United States Patent
Cornelius et al.

(10) Patent No.: US 6,253,052 B1
(45) Date of Patent: Jun. 26, 2001

(54) CONDUCTIVE COATING FOR CHARGING BLADE IN ELECTROSTATIC PRINTING PROCESSES

(76) Inventors: Lester Cornelius, 297 Raff Ave., Carle Place, NY (US) 11574; Robert Kacinsky, 33 Champlain St., Ronkonkoma, NY (US) 11779

( * ) Notice: Subject to any disclaimer, the term of this patent is extended or adjusted under 35 U.S.C. 154(b) by 0 days.

(21) Appl. No.: 09/346,951

(22) Filed: Jul. 1, 1999

Related U.S. Application Data

(62) Division of application No. 08/979,651, filed on Nov. 18, 1997, now Pat. No. 5,997,772.
(60) Provisional application No. 60/044,598, filed on Apr. 22, 1997.

(51) Int. Cl.[7] ..... G03G 15/08; G03G 15/09
(52) U.S. Cl. ..... 399/274; 399/284

(58) Field of Search ..... 399/274, 284

(56) References Cited

U.S. PATENT DOCUMENTS 5,085,171 * 2/1992 Aulick et al. ..... 399/284
5,168,312 * 12/1992 Aoto et al. ..... 399/284
5,570,166 * 10/1996 Ohzeki et al. ..... 399/274 X
5,623,718 * 4/1997 Bracken et al. ..... 399/284
5,702,812 * 12/1997 Bracken et al. ..... 399/284 X
5,853,868 * 12/1998 Bracken et al. ..... 399/284

* cited by examiner

*Primary Examiner*—Fred L Braun
(74) *Attorney, Agent, or Firm*—Charles E. Temko

(57) ABSTRACT

A flexible elongated roller charging blade for use as a replacement in the reycling of toner cartridges used in photoelectric copiers and printers. The blade has a first surface having a semiconductive coating, and a second opposite surface coated with an adhesive to apply to the surface of an initially installed charging blade.

3 Claims, 3 Drawing Sheets

CONDUCTIVE COATING FOR CHARGING BLADE IN ELECTROSTATIC PRINTING PROCESSES

This application is a division of application Ser. No. 08/979,651 filed Nov. 18, 1997, now U.S. Pat. No. 5,997, 772, entitled "Conductive Coating for Charging Blade in Electrostatic Printing Processes".

RELATED APPLICATION

Reference is made to our co-pending provisional application Ser. No. 60/044,598 filed Apr. 22, 1997 entitled Conductive Coating For Charging Blade In Electrostatic Printing Processes.

BACKGROUND OF THE INVENTION

This invention relates generally to the field of electrostatic printing processes, and more particularly to an improved coating applied to an elastomeric charging blade pressure against a developing roller which forms part of the developer apparatus used to develop an electrostatic image normally using single component toner.

One component toner, also known as monocomponent toner, is widely used in electrophotographic printers. The toner may also contain other additives used to improve flow characteristic and to control charging. The toner is triboelectrically charged by the friction developed in its movement through the developer apparatus. This friction occurs at the developer roller surface which is usually textured, and is increased by the use of an elastomeric blade placed in contact with the developer surface. The elastomeric blade also meters the layer of toner on the developer roller prior to image development.

Developer rollers used with monocomponent toners can create unequal charge distribution among different size toner particles. U.S. Pat. No. 4,989,044 discloses the variation in toner charge and related particles in the toner layer on the developer roller. The solution to equalize the charge, according to this patent, is to use a conductive coating on the developer roller surface. U.S. Pat. No. 5,027,745 discloses that the conductive coating described in U.S. Pat. No. 4,989,044 is usually short lived. This short life is even more pronounced with developer rollers using elastomeric blades pressed against them to increase the friction on the toner passing over the developer roller surface. The elastomeric blades significantly increase the wear of the developer roller surface.

The need for a conductive coating to equalize the toner charge is of particular importance in developer systems that use toner projection development, a process which is described in U.S. Pat. No. 4,292,387. The AC voltage applied to the developer roller causes sorting of the toner particles by size with the smaller higher charged particles migrating to the inside of the toner layer on the developer roller. This toner particle sorting by size results in lower image density and developer roller ghosting.

SUMMARY OF THE INVENTION

Briefly stated, the invention contemplates the provision of an improved flexible electrically conductive coating adapted to be applied to the charging blade, or at least the surface thereof which contacts the developer roller. In one embodiment, the coating is applied by dipping, painting, or spraying. In another embodiment, the coating material is incorporated into the material forming the charging blade prior to extruding or casting the same. In a third embodiment, particularly useful in reconditioning used blades, the coating applied to an adhesive strip which is subsequently applied to the operative surface of the blade.

BRIEF DESCRIPTION OF THE DRAWINGS

In the drawing, to which reference will be made in the specification.

DETAILED DESCRIPTION OF THE DISCLOSED EMBODIMENTS

Overview

Figure 1:
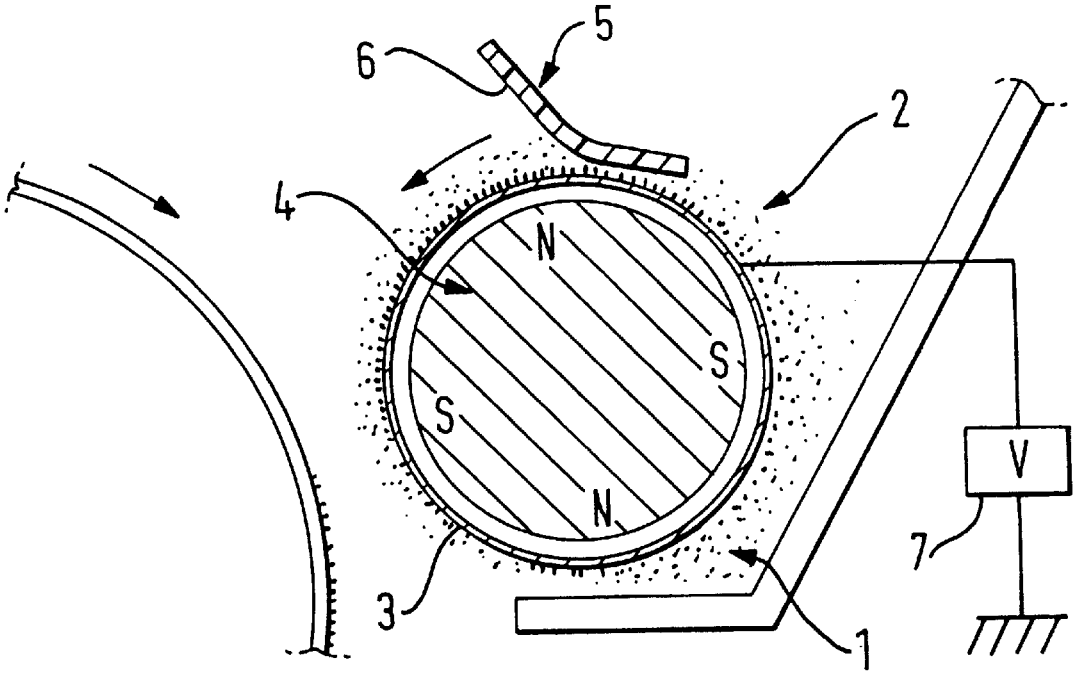
FIG. 1 is a schematic illustration showing a typical developer apparatus for monocomponent toner.

The advantage of applying a conductive coating to the elastomeric blade pressing against the developer roller is that it results in a longer life in this position than when the coating is applied on the developer roller. The developer roller requires a hard coating to resist abrasion and the elastomeric blade, hereinafter called the charging blade, requires a flexible coating. The charging blade coating does not need hardness because most of the blade in contact with the toner is not in contact with the much harder developer roller surface. The nip formed between the developer roller and the charging blade provides a large contact area between the outer layers of the toner and the charging blade, while the developer roller makes more of a contact with the innermost toner layer.

The area where the charging blade and the developer roller make contact is approximately 2–3 millimeters wide. In the area where the charging blade coating makes contact with the developer roller surface the coating abrades away very quickly. Along the much larger surface area of the nip both before and after the point of contact, the coating is not worn away after 300,000 revolutions of the developer roller. The same number of revolutions causes substantial wear on the developer roller.

A surface coating on the charging blade is more advantageous than making the entire charging blade conductive by dispersing a conductive material in the urethane or silicone. This is due to the decrease in abrasion resistance (See FIG. 2) wherein the charging blade contains a conductive dispersion. The surface coating wears away at the point of contact with the developer roller but the wear is limited when the developer roller reaches the homogeneous more abrasion resistant urethane substrate of the charging blade below the coating.

DETAILED DESCRIPTION OF THE DISCLOSED EMBODIMENTS

In accordance with the invention, the coating formulation is comprised of an aqueous or solvent based elastomeric material with good durability that contains a conductive material such as carbon black or graphite dispersed in its body to create conductivity. The surface resistivity of this coating ranges between $10^5$ ohms/square (conductive) and $10^{12}$ ohms/square (semi-conductive) when used in assemblies that have developer rollers with conductive coatings such as disclosed in U.S. Pat. Nos. 5,027,745 and 4,989,044. When the conductive coating charging blade is used in developer assemblies where the developer roller is not coated with a conductive coating, the surface resistivity range is from $10^2$ ohms/square and $10^{10}$ ohms/square, preferably between $10^8$ ohms/square and $10^9$ ohms/square. The optimum surface resistivity is dependent on the volume resistivity of the toner used. Higher volume resistivity toner, $10^{12}$ ohms/cm, works best with a lower surface resistivity coating on the charging blade. The higher resistivity toner tends to retain its triboelectric charge better than a more conductive toner. Conversely, as the toner volume resistivity decreases, the charging blade coating works better with a higher surface resistivity on the roller.

The two most common materials that the charging blades are made of are urethane and silicone elastomers. These are high surface resistivity materials, with measurements that can exceed $10^{15}$ ohms/square.

The coating can be made with a binder resin with both flexibility and wear resistance such as urethane, or vinyl. These can be, but are not limited to, solvent based one or two part urethane systems, one or two part vinyl systems: aqueous based urethane vinyl dispersions, solvent based acrylic systems, or aqueous based acrylic dispersions and emulsions. The preferred resin system is a urethane due to its high level of abrasion resistance. The coating flexibility is important due to the continuous flexing of the charging blade. A rigid coating can result in coating cracks developing in the charging blade coating which act as physical traps for toner which then creates print defects from disruptions in the toner layer on the developer roller.

When the surface coating on the developer roller described in U.S. Pat. No. 4,989,044 wears, it increases its resistance due to the decreasing concentration of conductive materials in the coating as the coating becomes thinner. This is due to a gradient of the principal conductive materials (FIG. 4) such as carbon black and graphite from high to lower concentration in the coating, with the highest concentration on the exposed surface. As the developer roller coating becomes thinner the non conductive resin concentration increases. As the surface resistivity increases from $<10^3$ ohms/square to $>10^6$ ohms/square, there is a corresponding decrease in image density and an increase in the tendency to create developer roller ghosting.

The conductivity of the described charging blade coating is homogeneous, as the conductive materials remain uniformly dispersed throughout the thickness of the coating. The uniformity of the dispersion throughout the charging blade coating thickness is greater with the aqueous dispersions. The aqueous urethane dispersions form films with insignificant gradients in conductivity, even in relatively higher film thicknesses.

The film thickness of the disclosed embodiments can range from 3 to 30 microns, with a preferable film thickness in the range of 10–15 microns. The film thickness is directly related to the life of the charging blade coating. Extremely high film thicknesses, above 30 microns tend to create toner starvation as a groove is worn in the less abrasion resistant charging blade coating with use.

The charging blade coating can be applied to the charging blades by a variety of methods, such as, but not limited to, dip coating, flow coating, and spraying. The only surface that requires coating is the surface that contacts the developer roller, however, there is no detrimental effect in coating all of the open surfaces as might occur in a dip coating process. The following examples are illustrative.

EXAMPLE 1

An Aqueous Urethane System

An aqueous urethane system consists of one of the following urethane dispersions:

Bayhydrol 110, Bayhydrol 140 or Bayhydrol 123 (Bayer USA)

Urethane solids are approximately 35% for each of the above dispersions.

| Formulation (Percentages by weight) | |
|---|---|
| Urethane solids | 20.0% |
| Flurad 430 (3M Co.) | 0.1% |
| Flurad 129 (3M Co.) | 0.1% |
| Quaternized neopentyl (diallyl) oxy, tri (diocty) pyro-phosphato titanate (Carter Chemical Co., Bayonne, NJ) | 0.5% |
| Isopropyl alcohol (optional) | up to 20.0% |
| Carbon black XC 272 (Cabot Corporation) based on urethan solids approximately | 1.0–5.0% |
| Graphite (optional) (Airco Spherical, St. Marys, PA) | 1.0% |
| Diluent deionized water (20 megohm) | balance to make 100% |

The formulation is mixed in a high shear mixer, such as a Cowles Mixer, until the carbon black and/or graphite is completely dispersed. The product formulation is room temperature stable for up to two years, but additional high shear mixing will be necessary from time to time to maintain the dispersion.

The coating is applied to a clean charging blade and it will become tack free in approximately twenty minutes. After the coating is tack free it is thermally cured for thirty minutes at 250 degrees F.

The preferred urethane dispersion is the Bayhydrol 110 which has superior wear characteristics. The XC 272 carbon black from Cabot Corp. is a highly conductive carbon black, which allows usage of a lower concentration in the binder resin which makes the formulated coating more durable.

The neopentyl(diallyl)oxy,tri(diocty)pyro-phosphato titanate is used to improve the dispersion of the conductive materials, improve the wetting of the coating system on the charging blade, improve the release properties of the toner from the charging blade coating, improve the leveling of the coating, and increase the flexibility of the coating. This titanate is one of a class of titanates known as neoalkoxy titanates and pyro-phosphato titanates. Other neoalkoxy titanates create the same improvements, although their efficiency is determined to a greater extent by the toner formulation. This group includes pyro-phosphato chelate titanates and neoalkoxy titanates which can be made into water soluble salts via quaternization; quaternization with amines takes place with the proton (H) provided by the hydroxyl (OH group) of the pyro-phosphato function. The quaternization of the titanate is accomplished by titrating an amine into the titanate until the pH ranges between 7 and 10.

Flurad 430 and Flurad 129 are surfactants that improve the wetting of the coating system when the coating is applied to silicone charging blades. The surfactants are not necessary for most charging blade materials other than silicone.

When this coating is applied to used charging blades, which are used in recycled all-in-one toner cartridges, the addition of isopropyl alcohol aids in wetting out the coating on the charging blade surface.

The result of using this conductive coating on the charging blade is a more uniform charging over a wider environmental range (from 10% relative humidity to 90% relative humidity) than blades without the coating. This results in better repeatability of print density. A new developer roller, in an all-in-one toner cartridge, depending on the type of toner cartridge, may last for 1.2 lifecycles of continuous running, without significant variation in image density. A lifecycle is defined as the number of pages required to deplete the toner from the toner cartridge. With a coated charging blade the number of lifecycles of the roller with consistent image density increased to 3 or 4, depending on the type of all-in-one toner cartridge. The speed of the printer, the toner that is used, the amount of toner in the cartridge, and the print usage, i.e. how many revolutions the developer roller makes to complete the cartridge lifecycle, all determine the lifecycle.

Substituting Bayhydrol 140 or Bayhydrol 123 aqueous urethane dispersions for the Bayhydrol 110 results in the same image density, but slightly shorter life of the charging blade. Typically, the charging blade lasts for 2.5–3 continuous run lifecycles. Substituting urethane solvent based coating, either aliphatic or aromatic results in continuous run lifecycles of 2.5–4. The aliphatic urethanes have slightly better lifecycle performance over aromatic urethanes. Whether the urethane is two part, having a separate isocyanate (TDI,HDI,MDI) and polyol, or single component urethane, such as a blocked isocyanate and polyol, is used appears to make no significant difference, except when tested against a number of toners from different manufacturers. The isocyanate type can produce different levels of image density, but the consistency is the same among the group.

If blocked isocyanates are used, they must unblock at a temperature low enough to prevent deforming of the charging blade, and they must have a high enough NCO content/resin mass, so that excessive amounts do not have to be used to increase the NCO content of the coating.

EXAMPLE 2

Substituting vinyl dispersions, or vinyl coating solutions results in continuous run lifecycles of between 1.8–2.2 in the same cartridge conditions. Acrylic dispersions, and acrylic solvent based coatings last longer than the vinyl based coatings, but not as long as the aliphatic urethanes. They typically last from 2.3–2.8 continuous run lifecycles.

An aqueous acrylic formulation employs

Joncryl 537 acrylic emulsion (from SC Johnson) Polymer supplied at 40% in water

| Formulation (percentages by weight) | |
|---|---|
| Acrylic non volatile emulsion (Joncryl 537) | 20.0% |
| Flurad 430 (3M Corp.) | 0.1% |
| Flurad 129 (3M Corp.) | 0.1% |
| Quaternized neopentyl (diallyl) oxy,tri (dioctyl) pyro-phosphato titanate (Carter Chemical Co., Bayonne, NJ) | 0.5% |
| isopropyl alcohol (optional) | up to 20.0% |
| Carbon black XC 272 (Cabot) based on acrylic non volatile content | approximately 1.0–5.0% |

-continued

| Formulation (percentages by weight) | |
|---|---|
| Graphite (optional) (Airco Spherical, St. Marys, PA) | 1.0% |
| Diluent deionized water (20 megohm) | balance to make 100% |

The diluent, deionized water, must be mixed with the Joncryl 537 prior to adding the other materials. Failure to do this will result in coagulation. The entire formulation must be mixed in a high shear mixer until the carbon black and graphite are uniformly dispersed.

EXAMPLE 3

An aqueous vinyl formulation employs

UCAR WBV 110 vinyl dispersion (Union Carbide) supplied at 50% solids

| Formulation (Percentages by weight) | |
|---|---|
| Vinyl solids in UCAR WBV 110 (Union Carbide) | 20.0% |
| Flurad 430 (3M Corp.) | 0.1% |
| Flurad 129 (3M Corp.) | 0.1% |
| Quaternized neopentyl (diallyl) oxy,tri (dioctyl) pyro-phosphato titanate (Carter Chemical Co., Bayonne, NJ) | 0.5% |
| isopropyl alcohol (optional) | up to 20.0% |
| Carbon black XC 272 (Cabot) based on acrylic non volatile content | approximatley 1.0–5.0% |
| Graphite (optional) (Airco Spherical, St. Marys, PA) | 1.0% |
| Diluent deionized water (20 megohm) | balance to make 100% |

The WBV is first diluted with water, then the balance of the materials are added and the entire formulation is mixed in a high shear mixer until the dispersion is uniform.

EXAMPLE 4

A solvent urethane formulation was prepared using

Desmophen 651A-65 (Bayer USA, Inc.) supplied at 65% solids OH content 5.2% and

Desmodur HL (Bayer USA, Inc.) supplied at 60% solids NCO content 10.5%.

| Formulation (percentages by volume) | |
|---|---|
| Desmodur HL | 11.75 |
| Desmophen 651 A-65 (This is a 20% solids urethane with a 1.1:1 NCO; OH ratio) | 19.9 |
| Flurad 430 (3M Corp.) | 0.1 |
| Flurad 129 (3M Corp.) | 0.1 |
| Quaternized neopentyl (diallyl) oxy,tri (dioctyl) pyro-phosphato titanate (Carter Chemical Co., Bayonne, NJ) | 0.5% |
| Carbon black XC 272 (Cabot) based on acrylic non volatile content approximately | 1.0–5.0% |
| Graphite (optional) (Airco Spherical, St. Marys, PA) | 1.0% |
| Diluent propylene glycol monomethyl ether acetate (PMA) | balance to 100% |

The Desmophen 651A-65 is first diluted with the PMA, then the Desmodur HL is mixed in, following which the balance of the materials are added and the entire formulation is mixed in a high shear mixer to obtain uniform dispersion of the carbon black and the graphite.

EXAMPLE 5

A solvent acrylic formulation is based on B 48S supplied at 40% solids from Rohm & Haas Co., Philadelphia, Pa.

| Formulation (percentages by volume) | |
|---|---|
| Acrylic solids B48S (Rohm & Haas Co.) | 20.0% |
| Flurad 430 (3M Corp.) | 0.1 |
| Flurad 129 (3M Corp.) | 0.1% |
| Quaternized neopentyl (diallyl) oxy,tri (dioctyl) pyro-phosphato titanate (Carter Chemical Co., Bayonne, NJ) | 0.5% |
| Carbon black XC 272 (Cabot) based on acrylic non volatile content approximately | 1.0–5.0% |
| Diluent propylene glycol mononethyl ether acetate (PMA) | balance to make 100% |

B48S is diluted with PMA, then the balance of the materials are added and the entire formulation is mixed in a high shear mixer until the dispersion is uniform.

EXAMPLE 6

A solvent vinyl formulation UCAR VYNC vinyl solution from Union Carbide supplied at 40% solids.

| Formulation (percentages by volume) | |
|---|---|
| Vinyl solids | 20.0% |
| Flurad 430 (3M Corp.) | 0.1 |
| Flurad 129 (3M Corp.) | 0.1% |
| Quaternized neopentyl (diallyl) oxy,tri (dioctyl) pyro-phosphato titanate (Carter Chemical Co., Bayone, NJ) | 0.5% |
| Carbon black XC 272 (Cabot) based on acrylic non volatile content approximately | 1.0–5.0% |
| Graphite (optional) (Airco Spherical, St. Marys, PA) | 1.0% |
| Diluent propylene glycol monomethyl | balance to make 100% |

An appreciation of the effect of the coating and its location may be gleaned from a consideration of the drawings.

In FIG. 1, a toner hopper 1 contains a supply of toner which is electrostatically attracted to a sleeve 3 on the developer roller 4. The charging blade 5 is made of an elastomeric material having conductive particles imbedded therein, typically, silicon with carbon particles. It is to the exposed surface 6 of this blade that the present coating is applied. The developer roller sleeve will typically have a voltage or voltages 7 applied to it to move the charged toner from the developer sleeve to the photo conductor. In order to increase the toner charge, the elastomeric charging blade 5 is pressed against the developer sleeve 3 to increase the friction between the toner and the developer sleeve, this friction increasing the toner triboelectric charge. Because of the presence of the conductive coating on the charging blade, this charge is evenly distributed over the surface of the developer sleeve and toner particles disposed thereon.

Figure 2:
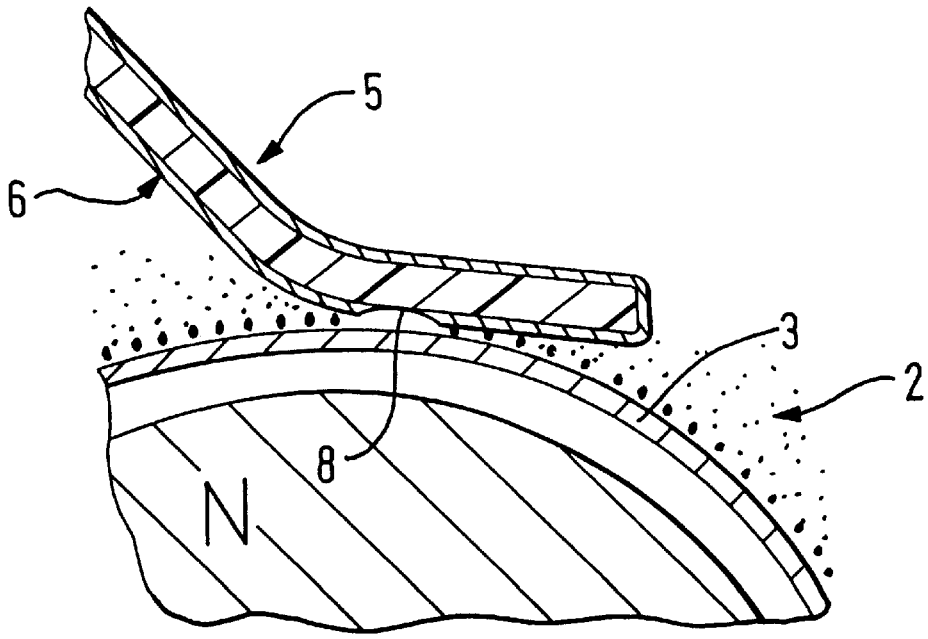
FIG. 2 is a schematic view of a charging blade disposed against a developer sleeve.

FIG. 2 is a magnified view of the charging blade disposed against the developer sleeve. The flexible conductive coating is applied to the undersurface 6 of the charging blade. There is illustrated, an area where the developer sleeve has worn through the conductive coating on the blade. This wear is stopped when the urethane substrate of the charging blade is reached.

Figure 3:
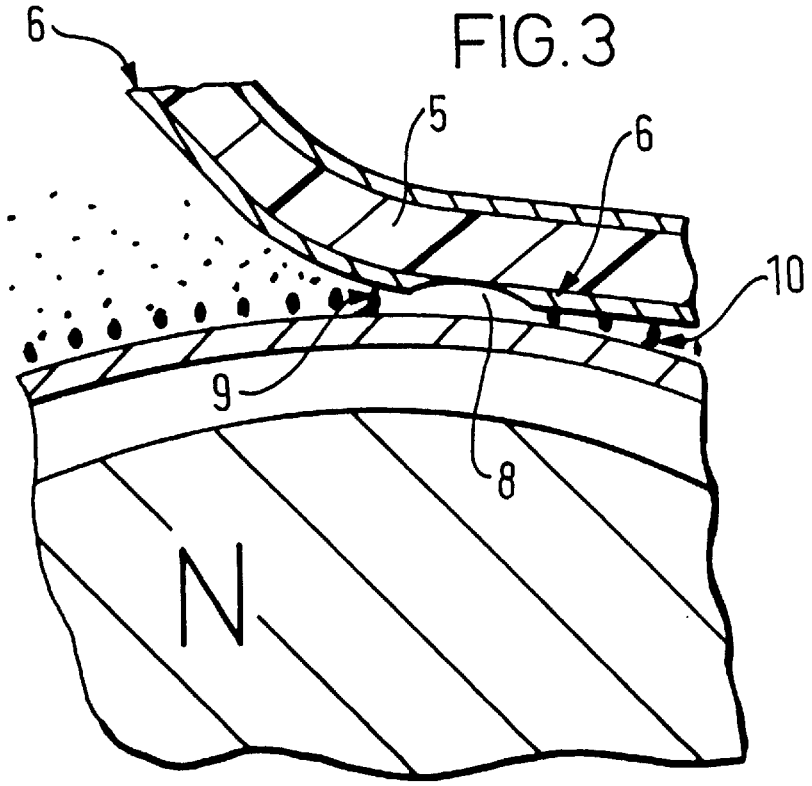
FIG. 3 is a schematic view showing the location of toner charging nips.

FIG. 3 is a further enlarged illustration showing the location of the toner charging nip 8, and illustrates the value of the flexible charging blade coating which is still effective after the coating is worn off in the area of direct contact with the developer roller.

Figure 4:
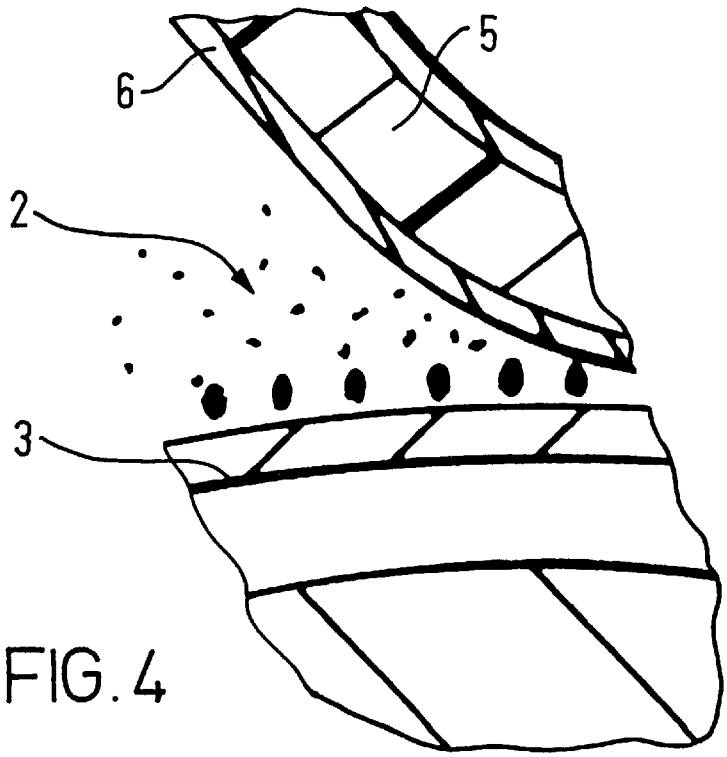
FIG. 4 is a schematic view showing the detail of a conductive coating on the developer roller sleeve.

FIG. 4 is a similar schematic illustration showing the detail of gradient of the conductive material in the coating rather than on the blade, and illustrates why the coating on the sleeve becomes less effective as the coating is worn.

Figure 5:
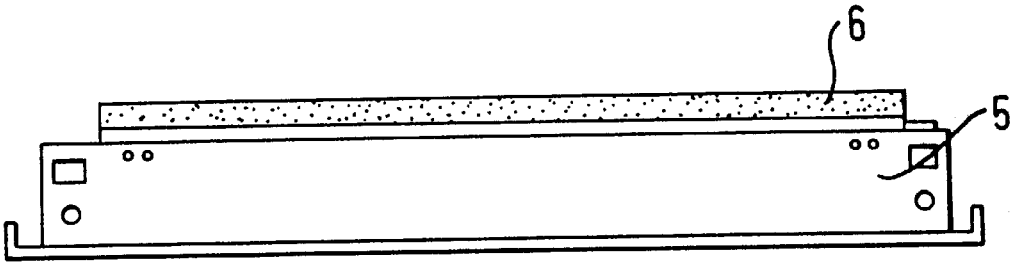
FIG. 5 is a schematic view of a flexible charging blade having a coated layer on an outer surface thereof.

In FIG. 5, the coated layer 7 is shown applied to the outer surface of the charging blade 5, as might be done during a stage of manufacture.

Figure 6:
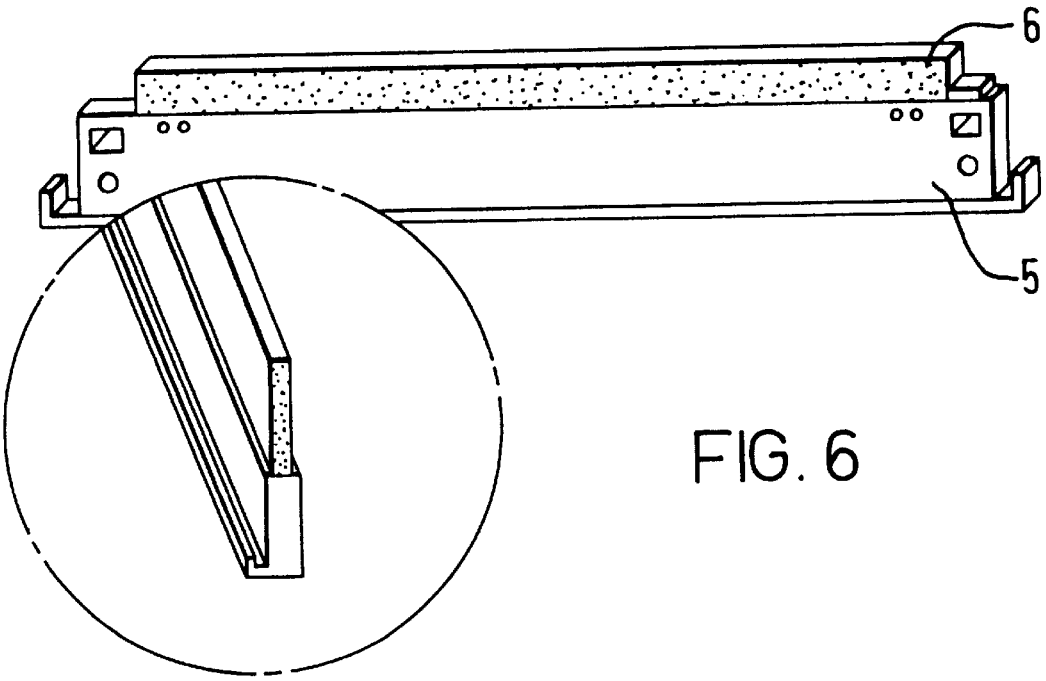
FIG. 6 is a schematic view of a flexible coating blade with the materials comprising the coating incorporated in the body of the blade.

In FIG. 6, the described coating materials are mixed into the body 6 of the material (excluding the solvents and surfactants) forming the charging blade prior to molding or extruding the same, wherein the coating is continuously exposed as the surface of the blade becomes worn.

Figure 7:
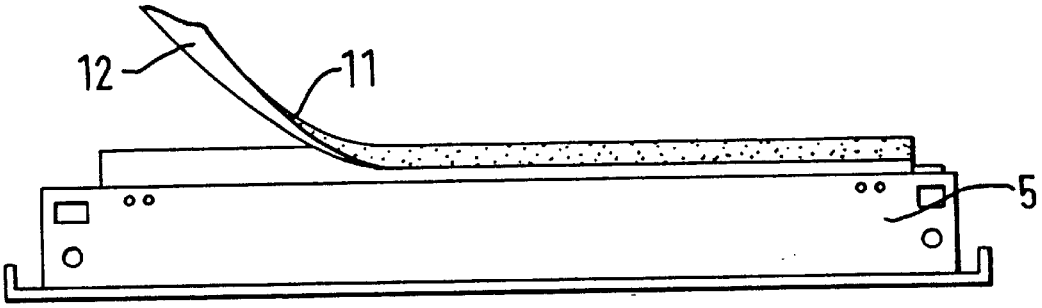
FIG. 7 is a schematic view of a flexible doctor blade in which the coating materials are applied to an adhesive strip, the strip being subsequently applied to an operative surface of the blade.

In FIG. 7, the coating has been applied to one surface of a separate flexible strip 11, with an adhesive 12 on the opposite surface to permit application to a used blade that is otherwise in serviceable condition.

We wish it to be understood that we do not consider the invention to be limited to the precise details set forth in the specification, for obvious modifications will occur to those skilled in the art to which the invention pertains.

We claim:

1. In an electrostatic printing assembly, including a developer roller having a magnetically charged sleeve for attracting toner particles to an outer surface thereof, and a charging blade in frictional contact with said surface, the improvement comprising: a flexible conductive coating applied to a surface of said blade in an area contacting said sleeve, said coating being applied to a surface of a separate adhesive strip for attachment to the surface of the blade in an area contacting said sleeve.

2. The improvement in accordance with claim 1, in which said conductive coating comprises an elastomeric material, selected from the group consisting of vinyl resins, urethane resins, and acrylic resins; a detergent; a quadernized titanate selected from the group consisting of neoalkoxy titanates and pyro-phosphoto titanates; and particulate carbon black; said coating ranging in thickness from 3 to 30 microns.

3. The improvement in accordance with claim 1, in which the coating is formed by mixing the materials comprising the coating into the body of material forming the strip at a stage of manufacture.

* * * * *